US007124769B2

(12) United States Patent
Sansom et al.

(10) Patent No.: US 7,124,769 B2
(45) Date of Patent: Oct. 24, 2006

(54) HIGH RISE TOWER SANITARY SERVICE SYSTEM

(75) Inventors: Clyde Sansom, St. Louis, MO (US); Jeff Moore, Boise, ID (US)

(73) Assignee: A Company Incorporated, Boise, ID (US)

( * ) Notice: Subject to any disclaimer, the term of this patent is extended or adjusted under 35 U.S.C. 154(b) by 0 days.

(21) Appl. No.: 11/252,474

(22) Filed: Oct. 17, 2005

(65) Prior Publication Data

US 2006/0032531 A1 Feb. 16, 2006

Related U.S. Application Data

(63) Continuation of application No. 10/850,345, filed on May 19, 2004, now Pat. No. 6,997,204.

(51) Int. Cl.
*F04F 3/00* (2006.01)

(52) U.S. Cl. ..... 137/14; 137/205; 137/357

(58) Field of Classification Search ..... 137/14, 137/205, 357, 360; 4/321, 323, 431
See application file for complete search history.

(56) References Cited

U.S. PATENT DOCUMENTS

| | | | | |
|---|---|---|---|---|
| 3,651,524 | A * | 3/1972 | Bengtsson et al. | 4/211 |
| 3,853,140 | A * | 12/1974 | Gorman | 137/357 |
| 4,129,906 | A * | 12/1978 | Ohringer | 4/211 |
| 4,246,925 | A * | 1/1981 | Oldfelt | 137/205 |
| 4,865,631 | A * | 9/1989 | Stroby et al. | 4/321 |
| 5,937,888 | A * | 8/1999 | McKiernan et al. | 137/205 |
| 6,092,549 | A * | 7/2000 | Eriksson | 137/357 |

* cited by examiner

*Primary Examiner*—Kevin Lee
(74) *Attorney, Agent, or Firm*—Derek H. Maughan; Dykas, Shaver & Nipper, LLP

(57) ABSTRACT

A system and method for servicing restrooms on the upper floors of a high rise building. The system is comprised of sections of hoses that are interconnected by valves, each valve configured to provide a user with the ability to selectively shut off the flow of material in a vertical or horizontal direction. These vacuum hoses are then connected to a liquid cooled pump, which is connected to a vacuum tank. The system operates by selectively opening and closing the vertical and horizontal valves to focus vacuum force in areas to be cleaned and prevent vacuum in non-desired areas.

14 Claims, 2 Drawing Sheets

HIGH RISE TOWER SANITARY SERVICE SYSTEM

CLAIM TO PRIORITY

This application is a continuation application and claims the priority date from the non-provisional application entitled HIGH RISE TOWER SANITARY SERVICE SYSTEM filed by Clyde Samson on May 19, 2004 with application Ser. No. 10/850,345, now U.S. Pat. No. 6,997,204, the disclosure of which is incorporated herein by reference.

BACKGROUND OF THE INVENTION

1. Field of the Invention

The present invention generally relates to portable restrooms, and more particularly to a system for servicing portable restrooms located upon various levels in a multi-story building.

2. Background Information

Portable restrooms are a convenience of the modern world. They provide individuals the ability to have a contained and sanitary location for urinating and defecating and provide a health benefit in that these restrooms contain and treat this waste with a liquid that prevents potentially pathogenic bacteria from proliferating. These devices are used at sporting events, weddings, construction sites, and in other locations where traditional permanent plumbing has not been made available. Sometimes these devices are provided simply for convenience, while in other circumstances they are mandated by law to provide sanitation.

A typical portable restroom is made up of four walls: a roof, a door, a seat, and a holding container. This holding container is configured to hold a quantity of waste that is deposited within the restroom by those persons utilizing the portable restroom. Over time these holding containers fill and must be emptied or serviced. This servicing is typically done by a pair of service personnel who drive a tank truck to the location where the portable restrooms are located. These trucks have tanks that are configured to hold a quantity of waste and a vacuum pump that is configured to draw the liquid out of the holding containers in the portable restrooms. They then pump this waste into the tank on the trucks. To perform this feat, the two persons servicing the restrooms typically drive the tank truck to a location and connect a hose or conduit to the pump. Additional hoses are then interconnected by T-valve combinations until sufficient length has been achieved so as to allow the hoses to reach from the tank to the portable restroom to be serviced.

Once the hose has been connected to achieve this length, one operator places one end of the hose into the holding container in the portable restroom and then signals the other operator at the truck to engage the vacuum pump. The pump then engages and pumps the material out of the holding container connected to the portable restroom, through the conduit, and into the holding tank. Once all of the material has been pumped out of the holding container, the operator at the end of the hose signals the operator at the vacuum pump that the portable restroom has been emptied, and after the conduit has been emptied, the pump is shut off. The two individuals operating the device then go to another location and repeat this process. Through this process, the individuals work to empty the various portable restrooms in a single location.

Portable restrooms may be utilized in situations and circumstances where the access to these portable restrooms by a service team is more difficult. One of those situations occurs when the portable restroom is located in an elevated position as compared to the position of the vacuum truck. In the prior art, this same system is utilized wherein one person drags the hose up to a higher level, places one end of the hose within the container to be emptied, signals his companion to engage the pump, and empties out the holding container.

In using such systems on buildings having multiple floors, a variety of problems arise. One of these problems is that the vacuum truck has insufficient suction capabilities to pump waste from high elevations and in distant locations to the pump truck. As a result of these flow problems, sludge and waste can clog and plug the device thus making the tank emptying process difficult. In addition, in some instances these devices are simply unable to pull material out of the holding tanks and into the trucks themselves. Another problem that arises is that the pumps overheat and must be turned off frequently in order to prevent damage to the pumps themselves and to prolong the life of these pumps. Most pumps in the industry will simply burn up if left running for prolonged periods of time. To do this, typically two individuals must be utilized to service a building. One individual sits in the vacuum truck and operates the vacuum tank motor by alternatively turning the motor off and on to effectuate the removal of the waste from the containers, while at the same time preventing the vacuum pump from overheating. He does this while the other individual services the various floors. This incurs substantial cost.

What is needed is a system or device for servicing portable restrooms, particularly those on multiple levels, which also provides increased pumping capabilities. What is also needed is a tower service system that prevents clogging or obstruction of the system by waste in the line. What is also needed is a device for servicing of portable restrooms that has increased functional capabilities as compared to the devices in the prior art. Another necessity is a system that allows a single user to both operate the truck and service the various floors without the requirement of two employees. Another needed item is to provide a device with increased suctioning capabilities for performing these services.

Accordingly, it is an object of this invention to provide a system or device for servicing portable restrooms, particularly those on multiple levels, which provides increased pumping capabilities. It is another object of the invention to provide a tower service system that prevents clogging or obstruction of the system by waste in the line. Another object of the present invention is to provide a device for servicing of portable restrooms that has increased functional capabilities as compared to the devices in the prior art. Another object of the invention is to provide a system with the aforementioned capabilities that further allows a single user to both operate the truck and service the various floors without the requirement of two employees.

Additional objects, advantages and novel features of the invention will be set forth in part in the description which follows and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

The present invention is a system for servicing restrooms on the upper floors of a high-rise building. The system is comprised of sections of vacuum hoses that are interconnected by specially designed T-valves. Each of these T-valves is configured to provide a user the ability to shut off the flow of material in either a vertical direction or in a horizontal direction, or both. These vacuum hoses are then connected to a liquid cooled pump connected to a vacuum tank. The vacuum hoses are temporarily mounted on the side of the building and sections of hoses are added on, as the building grows higher and higher.

At each floor, a T-valve made up of a horizontal valve and vertical valve is positioned and connected. The vertical valve shuts off the vacuum to the upper side of the building while the horizontal valve opens the vacuum to the hose that vacuums out the portable restrooms. The vertical valve remains closed the entire time that the operator is using the horizontal valve on that particular floor. Connected to the horizontal valve is a hose that extends to the service area and the operator is able to use a valve service hose at the restroom. When the valve service hose is activated, the waste from the restroom can travel into and down the hose to the vacuum truck at the base of the building. The vertical valve prevents the entire system from becoming vacuumized and enables the waste or liquid to flow freely down the conduit to the vacuum truck.

The present invention can be utilized with either a traditional air cooled pump, as is common in the art, or a liquid cooled vacuum pump, as is utilized in the preferred embodiment. In the preferred embodiment, the liquid cooled vacuum pump and the vacuum truck are positioned at the base of the building. This liquid cooled pump is more durable than the air-cooled pump and allows the pump to run all day long without wearing out prematurely. This configuration of a durable pump and dual horizontal and vertical valves to open and close the flow of material through the hose, enables a single operator to service restrooms alone, thus increasing the efficiency and decreasing the costs to the user.

The purpose of the foregoing abstract is to enable the United States Patent and Trademark Office and the public generally, especially the scientists, engineers, and practitioners in the art who are not familiar with patent or legal terms or phraseology, to determine quickly from a cursory inspection, the nature and essence of the technical disclosure of the application. The abstract is neither intended to define the invention of the application, which is measured by the claims, nor is it intended to be limiting as to the scope of the invention in any way.

Still other objects and advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive in nature.

DESCRIPTION OF THE PREFERRED EMBODIMENTS

Figure 1:
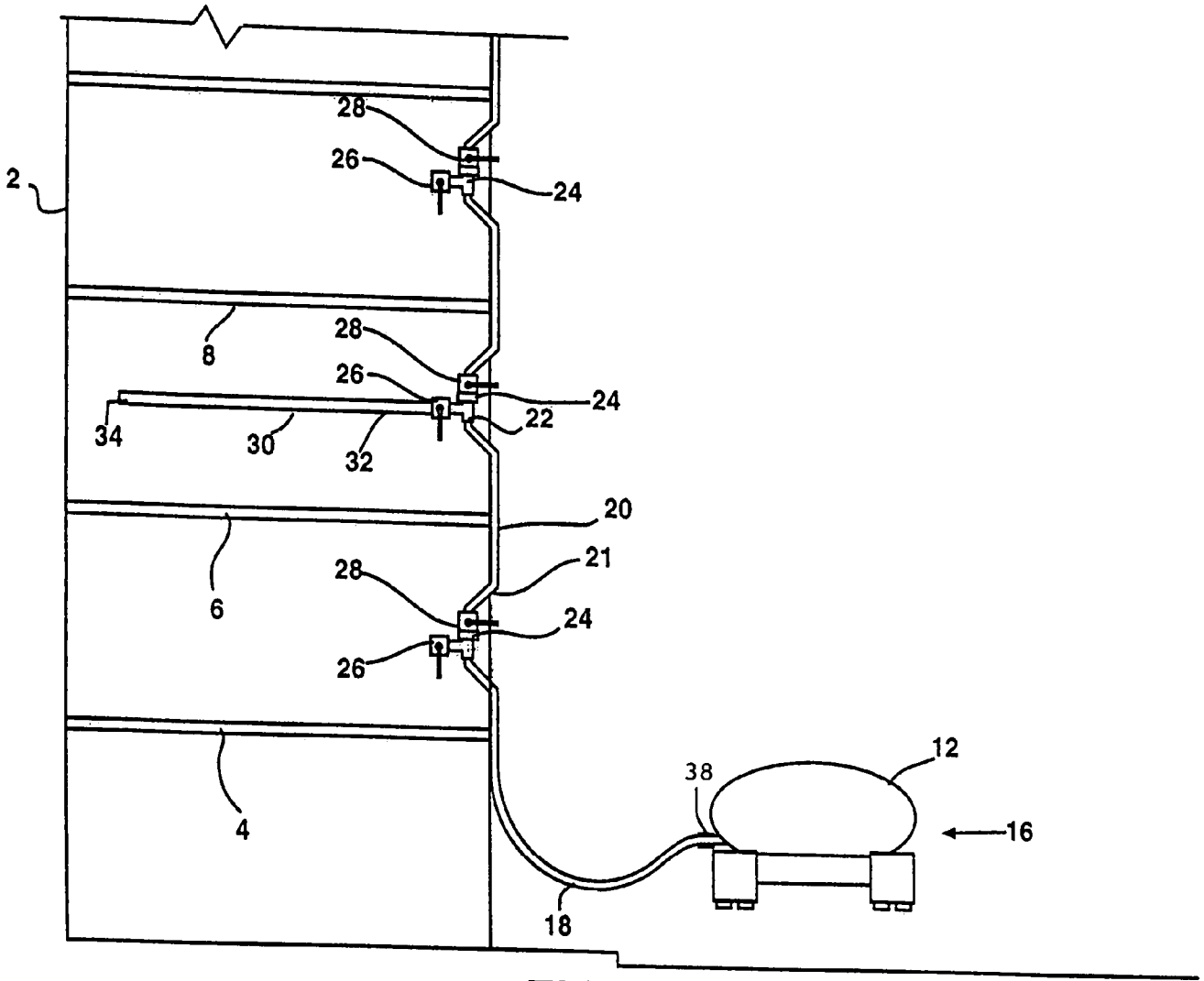
FIG. 1 shows a slide perspective view of the present system in a first preferred embodiment.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

Figure 2:
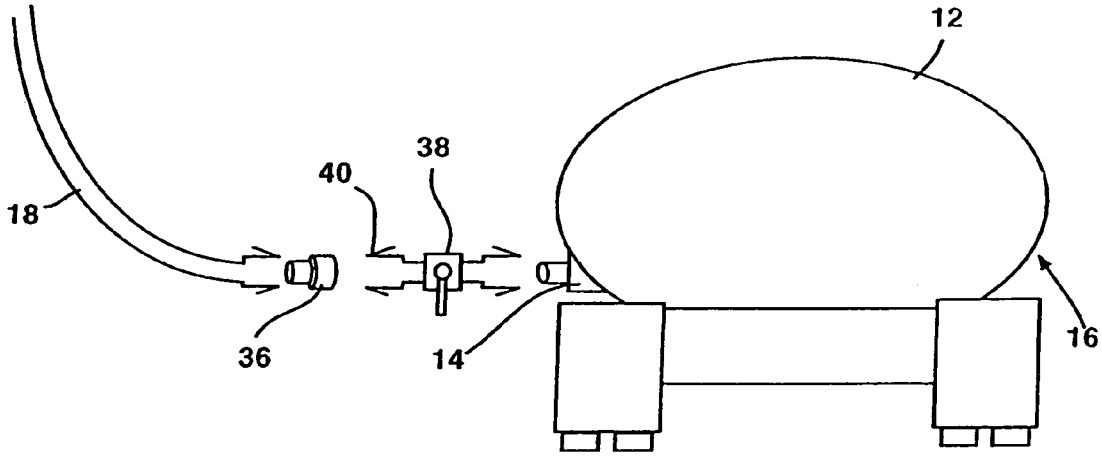
FIG. 2 is a detailed view of the embodiment shown in FIG. 1 demonstrating a connection between the vacuum truck and the vertical conduit.
Figure 3:
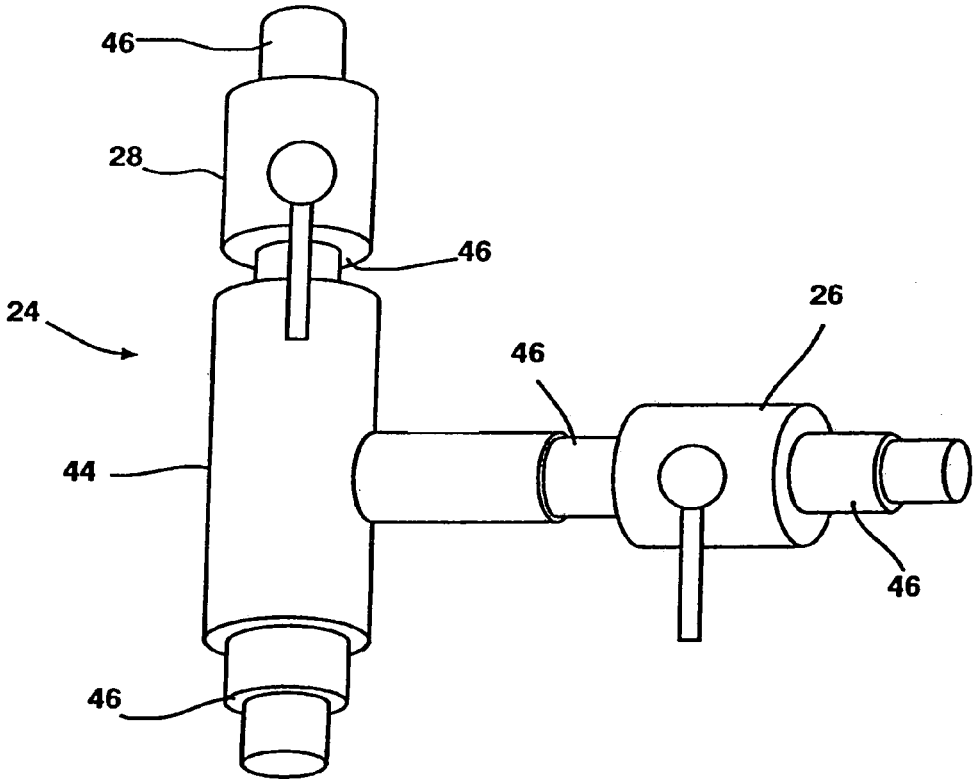
FIG. 3 is a detailed embodiment of the T-valves shown in FIG. 1.

Referring now to FIGS. 1–3, several views of the preferred embodiment of the present system is shown. As shown in FIG. 1, the present system is shown in use upon a building 2 having a plurality of floors 4, 6, and 8. Located on each of these floors is a portable restroom. While the present embodiment is shown as having three floors, it is to be distinctly understood that the present invention can be variously embodied to reach heights of up to 700 feet and/or buildings of up to fifty stories. The present system is configured to service these portable restrooms and is comprised of a vacuum tank 12 positioned upon a vacuum vehicle 16, typically a truck, which enables the vacuum tank 12 to be taken to a variety of locations. A vacuum pump is operatively connected to the vacuum tank 12 and is configured to create a vacuum sufficient to pull material through various conduit sections 18, 20, 30 into the vacuum tank 12.

In this preferred embodiment, the vacuum pump 14 is a liquid cooled pump that is integrally connected and wired for use with the truck itself. Preferably, this pump 14 has sufficient capacity to pump approximately 350 cfm. However, various other sizes and modifications may be made to the pump 14 as well. It is to be distinctly understood, however, that this example is merely illustrative and is not to be considered limiting in any manner.

This pump 14 is connected to tank 12, which typically has a capacity of 500 gallons. However, tanks of other capacities can also be utilized. This tank 12 is connected to a first conduit 18 in a manner that allows the connection to be held in a leak-proof and tight connection, while also being easily removable and replaceable. In the preferred embodiment, this is accomplished by connecting the first conduit 18 to a three-inch full flow ball valve 38 connected to a three-inch female aluminum coupler 40, which is connected to a three-inch to two-inch male-to-male reducer 36 that is configured to connect to a first conduit 18. A more detailed view of this connection is shown in FIG. 2.

The first conduit 18 is a vacuum hose like the other hoses 20, 30 also referred to as horizontal 30 or vertical 20 conduits that are used in the present invention. The conduits are vacuum hoses in the preferred embodiment being two inch 390 SD 100-psi hoses having a 300 psi burst rating and a twenty-nine inch vac. Each of these hoses is sectioned into appropriate lengths having female couplers on each end. In the preferred embodiment, the hoses are configured so that the first hose is approximately thirty-six feet in length and is configured to reach from the vacuum truck 16 to a second floor 4 of a building 2 to be serviced. Lengths of hose of approximately twenty-eight feet are then used to span from the second floor of the building being serviced to the fourth floor of the building being serviced and from the fourth floor of the building being serviced to the sixth floor being serviced. From the sixth floor, each additional piece of hose is approximately twenty feet in length. The system can be configured for use on a building up to fifty stories in height and an over a length of about 700 feet. While the dimensions of the various hoses and their method of connection in the preferred embodiment are set forth above, it is to be distinctly understood that this configuration is meant for illustrative purposes only and many various alternative configurations are also envisioned within the spirit and scope of this invention.

These hoses 18, 20, 30, are interconnected by T-valve combinations 24, which are made up of vertical valves 28 and horizontal valves 26. A detailed view of a preferred T-valve combination is shown in detail in FIG. 3. A first vertical hose 20, having a first end 21 and extending along a length to a second end 22 is connected to an open portion of a T-valve combination 24 and a second vertical hose 20' is connected to the upper portion of a vertical valve 28. This second conduit then extends to another T-valve combination wherein it is connected in a similar fashion until a desired height has been achieved. In the present embodiment, both the vertical valve 28 and the horizontal valve 26 are two inch full flow ball valves, which are configured to allow full flow of material through the T-valve combination 24 valve itself. In the preferred embodiment these ball valves 26, 28 are connected to a T-shaped conduit 44 by male couplers 46. Preferably, these two-inch male couplers are made of aluminum and allow the valves 26, 28 to connect to the T-shaped conduit 44 as well as other items such as hoses 20, 30 if no needed.

In use, the vertical conduit 20 is secured to a building in such a way that the hoses are generally vertically aligned in a straight up and down orientation. Preferably, these hoses are tied to the building in order to secure them. However, a variety of other types of devices that also secure these hoses to the building may also be utilized. These vertical hoses 20 are positioned so that a T-valve combination 24 is positioned approximately three feet above the level of the floor, upon the floor that is to be cleaned. A horizontal hose 30 is connected to the horizontal valve 26 and extended toward the restroom. Each of these horizontal hoses having a first end 32 and a second end 34. In a preferred embodiment, the restrooms to be cleaned are positioned within twenty feet of the T-valve sets which may be connected either to the outer portions of the building or placed within the plumbing crawl spaces where the permanent water and plumbing will ultimately be positioned. This positioning allows a single horizontal hose to reach from the T-valve combination 24 to the restroom to be cleaned. However, depending upon the necessities of the user, multiple horizontal hoses 30 may be utilized to reach the desired location. Preferably, each of the horizontal hoses 30 is a typical service hose that contains a wand that is configured to be inserted inside the holding container of the restroom to be cleaned and a service valve that allows material to be suctioned through the device. This service hose 30 assists in facilitating the passage of sewage or sludge from the holding container to the vacuum truck.

Once the system is connected as described, it is utilized by engaging the pump 14. Since the pump 14 is a liquid cooled pump and since the invention allows the vacuum pressure to be utilized solely in those locations where the pressure is needed, a single user can simply turn on the pump 14, lock the truck, and go into the building to service the restrooms. At the first floor to be cleaned, the user closes the vertical valve 28 on the T-valve combination 24 and opens the horizontal valve 26 on this same T-valve combination 24. By doing this, the user prevents the remaining parts of the system from having a vacuum applied to them and allows the maximum amount of vacuum through the horizontal conduit 30. The horizontal conduit 30 is then placed within a container that is to be cleaned and the waste is sucked out. When all of the various restrooms on this level have been cleaned and serviced, the user closes the horizontal valve 26 and opens the vertical valve 28 on the T-valve combination 24. The user then goes up to the next floor and repeats these same steps. This process is then repeated until all of the restrooms in a particular building have been cleaned.

This invention provides a significant number of advantages over the inventions shown in the prior art. First, by closing the vertical valve 28 above the floor to be cleaned, the user ensures that only those portions of the system that must have vacuum pressure within them are open and thus focuses the vacuum pressure upon the waste that is being sucked through the device. Second, this system prevents clogs in the vacuuming system from forming because the vacuum pressure is always contained and controlled. Third, because this system utilizes a liquid cooled pump, the pump 14 can be run continuously, thus allowing a single person to utilize the invention and increasing the efficiency and cost effectiveness of the invention itself.

While there is shown and described the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

We claim:

1. A system for servicing portable rest rooms on multistory buildings comprising:

a vacuum pump operatively connected to a storage tank, a conduit, said conduit connected in a vertical orientation against a building structure, said conduit having a first end configured to connect to said vacuum tank and extending along a length to a second end, said conduit having at least one valve connected between said first end and said second end, said valve configured to connect with a second conduit oriented in a horizontal direction.

2. The system of claim 1 wherein said conduit further comprises at least one vertical valve configured to prevent flow of material in a generally vertical direction.

3. The system of claim 1 wherein said conduit is comprised of a plurality of interconnected sections.

4. The system of claim 3 wherein said sections are connected at junctions, each of said junctions having a portion connected to a valve.

5. The system of claim 4 wherein said junctions are valves.

6. The system of claim 1 wherein said pump is a liquid cooled vacuum pump.

7. The system of claim 5 wherein said valves are positioned in a location approximately three feet above a floor surface.

8. A system for servicing portable rest rooms on multistory buildings comprising:

a vertical conduit connected in a generally vertical orientation along the side of a building, said vertical conduit having a first end configured for connection with a vacuum tank and extending along a length to a second end, said vertical conduit having at least one valve positioned between said first end and said second end.

9. The system of claim 8 wherein said valve is a horizontal valve configured to prevent the flow of material in a horizontal direction.

10. The system of claim 8 wherein said valve is a vertical valve configured to prevent flow of material in a generally vertical direction.

11. The system of claim 10 further comprising a horizontal valve configured to prevent the flow of material in a horizontal direction.

12. The system of claim 11 wherein said vertical valve and said horizontal valve are interconnected through a T-valve combination.

13. The system of claim 12 further comprising a horizontal conduit connected to said horizontal valve; said horizontal conduit connected to a service wand, said service wand configured to be inserted within a portable restroom tank.

14. In a system for servicing portable rest rooms on multistory buildings having a vacuum pump operatively connected to a storage tank, a vertical conduit having a first end connected to said vacuum tank and a second end, and at least one valve connecting said vertical conduit to a horizontal conduit, a method of servicing restrooms comprising the steps of:

engaging said vacuum pump;

opening said horizontal valve;

cleaning and servicing said desired location; and closing said horizontal valve.

* * * * *